United States Patent [19]

Berner

[11] Patent Number: 4,727,931

[45] Date of Patent: Mar. 1, 1988

[54] AIR EXCHANGING APPARATUS AND METHOD

[76] Inventor: Erling Berner, Loretohohe 5, CH-6300 Zug, Switzerland

[21] Appl. No.: 864,056

[22] Filed: May 16, 1986

Related U.S. Application Data

[63] Continuation-in-part of Ser. No. 709,458, Mar. 8, 1985, abandoned.

[51] Int. Cl.[4] ..... F28D 19/00

[52] U.S. Cl. ..... 165/8; 165/909

[58] Field of Search ..... 98/31, 31.6, 32, 33.1, 98/38.2; 165/7, 8, 9, 54, 909

[56] References Cited

U.S. PATENT DOCUMENTS 2,183,936 12/1939 Karlsson et al. ..... 165/8 X
3,491,537 1/1970 Stopa ..... 165/8 X
4,172,164 10/1979 Meyer et al. ..... 165/54
4,512,392 4/1985 van Ee et al. ..... 165/54
4,512,393 4/1985 Maendel ..... 165/54
4,513,809 4/1985 Schneider et al. ..... 165/54

FOREIGN PATENT DOCUMENTS 58-99627 6/1983 Japan ..... 98/33.1

*Primary Examiner*—Harold Joyce
*Attorney, Agent, or Firm*—Kirkpatrick & Lockhart

[57] ABSTRACT

Apparatus for exchanging contaminated room air with fresh outdoor air and a method for operating same is disclosed. The apparatus includes a housing having a pair of substantially parallel air passageways sealed from one another and providing fluid communication between the room and the outdoors. A heat recovery rotor is disposed in the air passageways in an inclined orientation.

1 Claim, 6 Drawing Figures

AIR EXCHANGING APPARATUS AND METHOD

BACKGROUND OF THE INVENTION

CROSS REFERENCE TO RELATED APPLICATION

This is a continuation-in-part application of U.S. Ser. No. 709,458, filed Mar. 8, 1985 now abandoned.

FIELD OF THE INVENTION

This invention relates to a method and apparatus for exchanging contaminated room air with fresh outdoor air; more particularly, to the orientation of a heat recovery rotor in such apparatus in order to produce efficient operation without adversely affecting the overall size of the apparatus.

DESCRIPTION OF THE PRIOR ART

There is developing an increased awareness of the need for regularly removing contaminated air from within buildings and residences and replacing that air with fresh air from the outdoors. In performing this air exchange operation, due consideration must be given to the differences in air temperature and humidity that may exist between indoors and outdoors. In order to avoid defeating the benefits of air conditioning and/or heating systems, it is therefore desirable to provide at least a heat exchange operation and often a moisture removal step in conducting the air exchange operation.

One type of apparatus that has been found useful for this purpose is one that employs a heat recovery rotor which turns slowly in the counter-flowing paths of fresh air and exhaust air; these paths are provided within a housing and are sealed from one another to prevent cross contamination. The slowly turning rotor absorbs the energy of the air being exhausted from a room and releases that energy to fresh air flowing from outside into the room. The rotor may be impregnated with a moisture absorbing agent to control the humidity of the fresh air being supplied to the room.

Because the rotor represents an obstacle to the free flow of air in the two passageways, a static pressure loss is experienced across the rotor. Since fans are used to move the fresh air and the exhaust air, it is desirable that static pressure losses in the system be minimized so that fans of relatively small size and having relatively low power requirements may be used.

It has been found that the ideal orientation of the rotor with respect to the air passages is where the axis of rotation of the rotor is generally parallel to the axes of the air passages. This orientation means that the air flow is substantially normal to the opposed surfaces of the rotor and the lowest static pressure loss across the rotor thereby is experienced. There are, however, cases where it is not possible to allow sufficient height in the housing to permit orientation of the rotor in this manner; for example, when the apparatus must be installed under the beam of a concrete structure, the height of the housing must be minimized. Such conditions may require that the diameter of the rotor be reduced. A reduction in rotor diameter, however, means an increase in rotor thickness to maintain comparable heat exchange capacity and such an increase in thickness results in an increased static pressure loss across the rotor at comparable conditions of air flow and velocity.

A more common problem, however, arising from limited vertical clearances in ceiling mounted air exchange units is the situation where the rotor must be mounted on a vertical axis of rotation and the airstreams enter the unit generally parallel with the plane of rotation of the rotor. This arrangement produces large static pressure losses across the rotor.

An object of the present invention, therefore, is to provide an air exchanging apparatus which is compact in size without reducing the diameter of the rotor. A further object of the invention is to provide a method for operating an air exchanging apparatus without experiencing high static pressure losses across the rotor.

SUMMARY OF THE INVENTION

The present invention provides a method for reducing the static pressure loss across a heat recovery rotor of an air exchanging apparatus in which incoming air enters the apparatus in a substantially horizontal stream; the method comprises the step of inclining the plane of rotation of the rotor so that the plane of rotation and the incoming airstream form an acute included angle.

The present invention further provides apparatus for exchanging contaminated room air with fresh outdoor air. The apparatus includes a housing having a pair of substantially parallel air passageways sealed from one another for exhausting contaminated air and supplying fresh air in countercurrent flow. Mounted for rotation within the housing is a heat recovery rotor which rotates slowly through the sealed air passageways. The improvement of the present invention comprises inclining the plane of rotation of the heat recovery rotor at an angle, with respect to the axes of the air passageways, which produces substantially equal static air pressure across the opposed surfaces of the rotor.

The invention thus permits the use of a compact housing while minimizing the static pressure drop across the rotor. The latter feature permits operation of the air exchanging apparatus at relatively high efficiency and at relatively low noise levels.

Other advantages of the invention will become apparent from the following detailed description, taken with the accompanying drawings, in which:

DETAILED DESCRIPTION OF THE PREFERRED EMBODIMENTS

Figure 1:
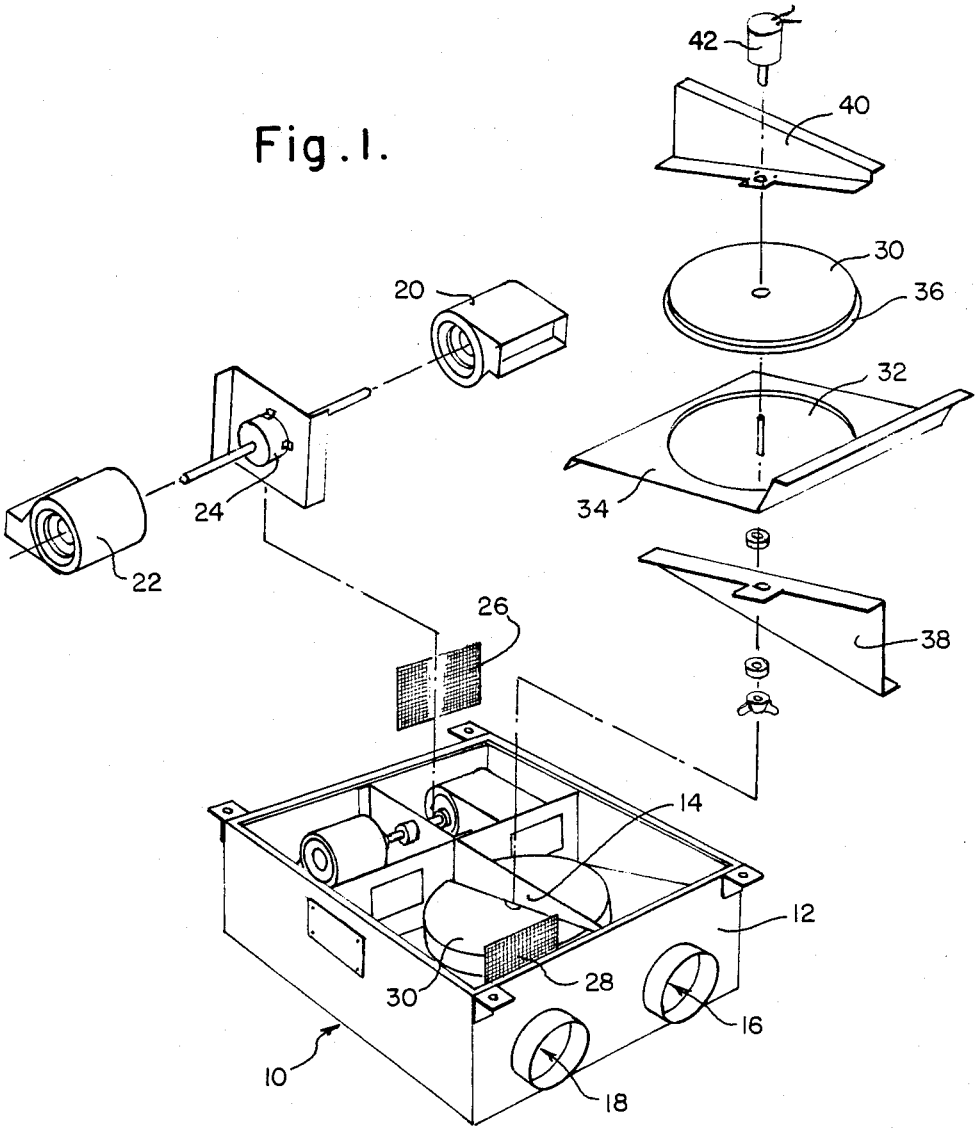
FIG. 1 is an exploded perspective view of an air exchanging apparatus embodying the present invention.

Referring to the drawings, particularly to FIG. 1, there is shown an air exchanging apparatus 10 suitable for mounting to a ceiling or some other overhead structure. Apparatus 10 includes a box-like housing 12 (with the top cover removed in FIG. 1) divided by a longitudinally extending partition 14 to provide an intake passage 16 and an exhaust passage 18. Air movement through passages 16, 18 is provided by intake fan 20 mounted in intake passage 16 and exhaust fan 22 mounted in exhaust passage 18. Fans 20, 22 are driven on a common shaft by motor 24. Filters 26, 28 are mounted respectively at the intake ports to passageways 16, 18.

Mounted for rotation in passageways 16, 18, on opposite sides of partition 14, is a heat recovery rotor 30. Rotor 30 may be of well-known design and may be constructed of aluminum, plastic, paper and like in a honeycomb structure to provide a large surface air for heat exchange purposes. In certain applications, the surface of rotor 30 may be impregnated with a moisture absorbing agent to provide humidity control of the air passing therethrough. Rotor 30 is dimensioned to be snugly received in opening 32 of horizontal partition plate 34 and is provided with a circumferential seal 36 to prevent leakage of air across the outside surface of rotor 30. Rotor 30 is mounted between triangular-shaped support plates 38, 40, which form part of partition 14. Rotor 30 is driven by motor 42 at relatively slow speed, e.g. in the range of about 10–20 rpm.

Figure 5:
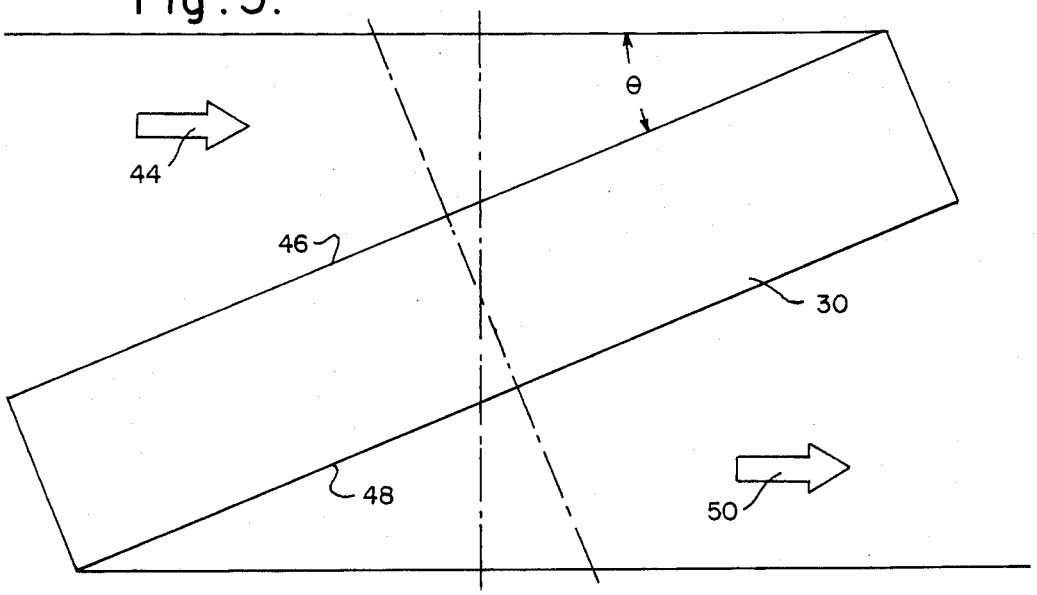
FIG. 5 is a diagrammatic showing of an inclined heat recovery rotor and its relationship with an incoming airstream.

As best shown in FIG. 5, rotor 30 is mounted in inclined fashion with respect to the incoming airstream (designated by the arrow 44) so that the plane of rotation of rotor 30 and the incoming airstream form an included angle $\theta$. By geometric principles, the axis of rotation of rotor 30 is inclined from the vertical at the same angle. After the incoming air passes through rotor 30, i.e., across opposed surfaces 46, 48, the air flows away from the rotor (as represented by the arrow 50).

As alluded to above, it is desirable both from the standpoints of operating efficiency and noise control that the static pressure loss across rotor 30 be minimized. It is well known that the static pressure loss across rotor 30 will be minimized under any given. conditions of air flow, air velocity, rotor dimensions and construction and configuration of housing 12, when the static pressure across opposed surfaces 46, 48 of rotor 30 is substantially equal. Achieving such static pressure equalization is governed by well-known principles and depends primarily on the configuration of the chamber above and below the rotor, the angle between the rotor and the incoming airstream, the air flow rate and velocity, and the presence of objects such as baffles in the airstream. One well-known method for determining that pressure equalization is achieved is to place pressure sensors across the surfaces 46, 48 of rotor 30 and adjust the angle of inclination of the rotor until equalization is measured. Another technique for establishing the optimum angle of inclination for rotor 30 is to calculate the angle using well-known formula and applying the physical factors mentioned above.

Figure 6:
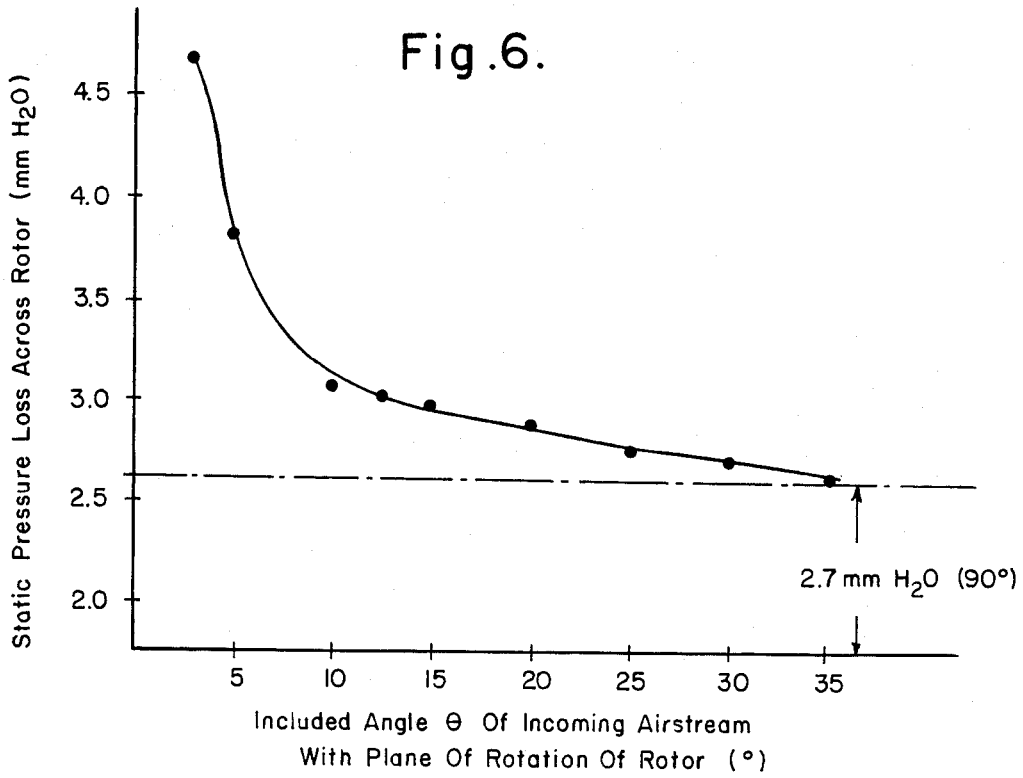
FIG. 6 is a curve showing static pressure loss as a function of the included angle of an incoming airstream with the plane of rotation of a heat recovery rotor.

As shown by the curve plotted in FIG. 6, the amount of inclination of rotor 30 need not be great to achieve the desired result, viz. minimal static pressure loss across rotor 30. When the plane of rotation of the rotor forms an included angle with the incoming airstream (angle $\theta$) of zero or near zero, the static pressure loss across the rotor is relatively high. By inclining the plane of rotation of the rotor a small amount, say about 5°, the static pressure loss decreases at a rapid rate; the curve then becomes less steep as angle $\theta$ is increased. The condition in which the airstream and the plane of rotation form an included angle of 90° results in the minimum static pressure loss of 2.7 $mmH_2O$. According to FIG. 6, which represents an actual test wherein the face velocity of the airstream was 1 M/s, an included angle $\theta$ selected in the range of about 10° to 35° would produce satisfactory results. In any case, the included angle between the plane of rotation of rotor 30 and the incoming airstream would be an acute angle.

Figure 2:
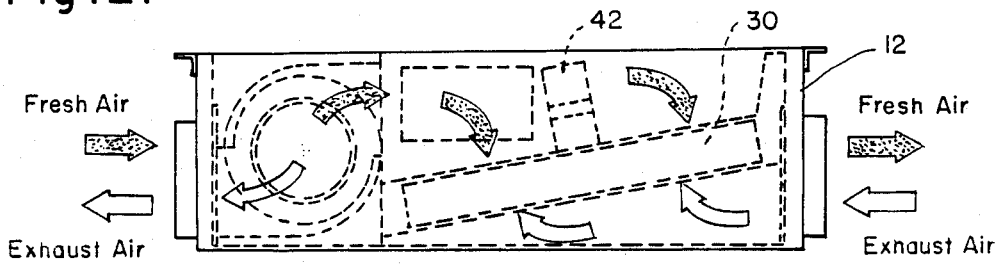
FIG. 2 is a left side view of the apparatus of FIG. 1.
Figure 3:
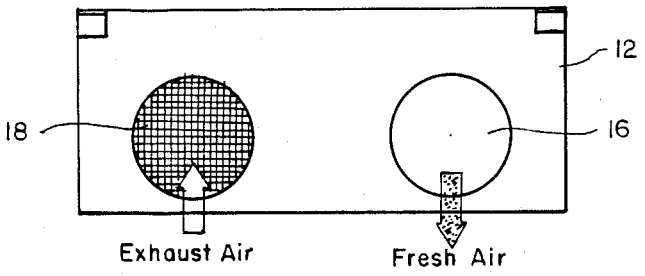
FIG. 3 is an end view of the apparatus of FIG. 2 viewed from the right.
Figure 4:
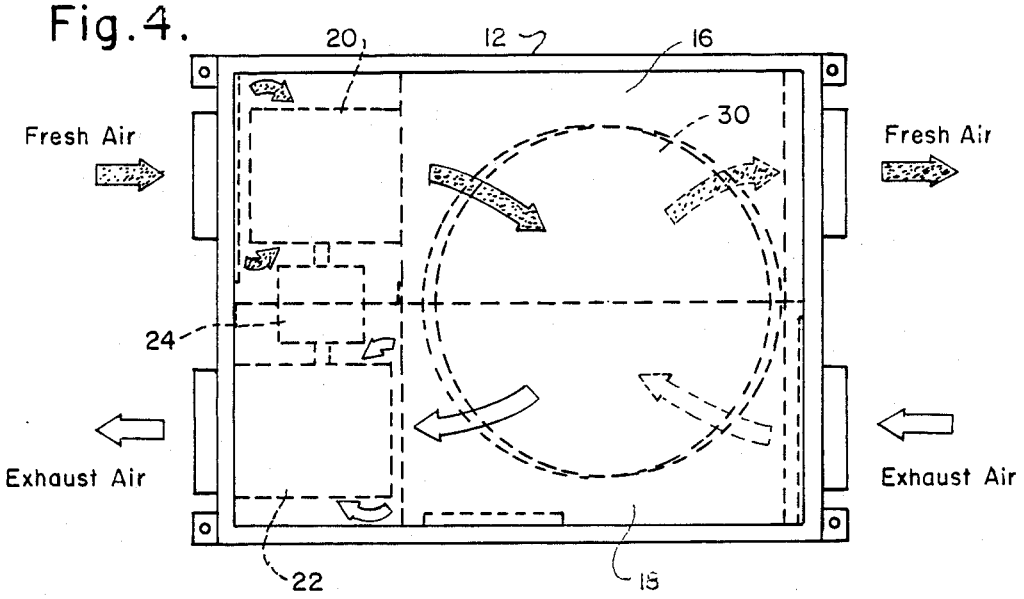
FIG. 4 is a top plan view of FIG. 1.

In the operation of the present invention, after the proper angle of inclination of rotor 30 is established by either of the techniques discussed above, fresh air from the atmosphere is drawn by fan 20 through air passage 16. The fresh air passes through rotor 30 from the top downwardly (see FIGS. 2 and 4) and out of housing 12 into a room. Contaminated air is drawn by fan 22 through air passage 18. The contaminated air passes through rotor 30 from the bottom upwardly (see FIGS. 2 and 4) and out of housing 12 to the outside atmosphere. As the respective air streams pass through rotor 30 in their sealed passageways, heat exchange (and possibly moisture absorption/release) is carried out.

What is claimed is:

1. A method for reducing the static pressure loss across a heat recovery rotor of an air exchanging apparatus in which incoming air enters the apparatus in a substantially horizontal stream, said method comprising the step of:

inclining the plane of rotation of said rotor so that said plane and said incoming airstream form an acute included angle.

* * * * *